US005934827A

United States Patent [19]

Kirby

[11] Patent Number: 5,934,827

[45] Date of Patent: Aug. 10, 1999

[54] REGENERATION OF TIDAL MUD FLATS

[75] Inventor: Robert Kirby, Somerset, United Kingdom

[73] Assignee: Ravensrodd Consultants Limited, Somerset, United Kingdom

[21] Appl. No.: 08/737,519

[22] PCT Filed: May 12, 1995

[86] PCT No.: PCT/GB95/01086

§ 371 Date: Nov. 12, 1996

§ 102(e) Date: Nov. 12, 1996

[87] PCT Pub. No.: WO95/31608

PCT Pub. Date: Nov. 23, 1995

[30] Foreign Application Priority Data

May 12, 1994 [GB] United Kingdom ..... 9409445

[51] Int. Cl.[6] ..... F02B 3/04

[52] U.S. Cl. ..... 405/21; 405/15

[58] Field of Search ..... 405/15, 21, 25, 405/26, 74

[56] References Cited

U.S. PATENT DOCUMENTS

| | | | |
|---|---|---|---|
| 307,393 | 10/1889 | Hyde | 405/26 |
| 3,628,334 | 12/1971 | Coleman | 405/26 |
| 4,552,590 | 11/1985 | Parker et al. | 405/17 |
| 4,669,913 | 6/1987 | Temple | 405/15 |
| 4,710,056 | 12/1987 | Parker | 405/15 |
| 4,824,285 | 4/1989 | Trierweiler | 405/15 X |
| 5,149,227 | 9/1992 | Parks | 405/15 X |
| 5,255,997 | 10/1993 | Bailey et al. | 405/15 X |

FOREIGN PATENT DOCUMENTS

| | | |
|---|---|---|
| 2393110 | 12/1978 | France . |
| 35 03 031 | 7/1986 | Germany . |
| 671985 | 10/1989 | Switzerland . |

OTHER PUBLICATIONS

Polytechnisch Tijdschrift; Bouwkunde Wegen–En Waterbouw, vol. 28, No. 22, pp. 723–730, Ing. L. Sterkman 'oeververdediging, oeverontsluiting en recreatie' see figures, Oct. 1973.

Friedrichs C.T. & Aubrey D.G. 1996 'Uniform bottom shear stress and equilibrium hypsometry of intertidal flats', in Pattriaratchi C. (Ed.) 'Mixing Processes in Estuaries & Coastal Seas', Coastal & Estuarine Studies Series, American Geophysical Union, Washington, D.C. 1996.

*Primary Examiner*—Tamara L. Graysay
*Assistant Examiner*—Frederick L. Lagman
*Attorney, Agent, or Firm*—Nath & Associates; Harold L. Novick

[57] ABSTRACT

A method of regenerating tidal mud flats which have a degraded or eroding profile includes the steps of ascertaining the ambient tidal range and wave climate of a mud flat to be regenerated and deriving from these data a new, regenerated profile for the mud flat, and depositing densified or dewatered mud or clay on the mud flat to build the new profile. The wave climate, and hence the sedimentary regime, of the mud flat is modified by breakwater or barrier means to render the mud flat receptive to deposition and retentive of the deposited mud or clay to preserve the regenerated profile. The breakwater or barrier means may be an offshore, floating breakwater adapted to suppress high and short-period waves but to permit the passage of low and long-period waves.

11 Claims, No Drawings

REGENERATION OF TIDAL MUD FLATS

The present invention relates to the regeneration of tidal mud flats, that is, unvegetated muddy shorelines.

The value of sandy shorelines has long been appreciated and a number of methods have been employed to counter the erosion of such shorelines, particularly in the case of so-called amenity beaches in holiday resorts. These measures range from the building of groynes to check erosion to the nourishing of beaches with sand dredged from offshore to replace the sand lost by erosion.

Muddy shorelines, on the other hand, have not been afforded protection unless the land behind the shore was considered to be of value for agriculture, habitation or industry. Traditionally, muddy shorelines have been protected against erosion by the planting of salt-tolerant vegetation to encourage the development of salt marshes which trap mud and raise the profile of the shore to build a natural rampart against the sea. More recently, a policy of strategic retreat has been adopted in areas where shore defences are not viable, leading to the abandonment of land.

There is a need for an effective method of managing eroding or degraded muddy shorelines which can be employed, for example, when the development of a salt marsh is not acceptable for environmental reasons and where strategic retreat is not possible because the land behind the shore represents a valuable industrial or residential investment.

The object of the present invention is to fulfil this need. The invention aims to make use of the results of recent hypsographic measurements of muddy shorelines in estuaries and bays. These measurements have revealed that the profile of a shoreline, taken from the sub-tidal or low-tide zone to the high-tide or supra-tidal zone, is low and concave in the case of an eroding or degraded muddy shoreline at equilibrium but is high and convex-tending in the case of an accreting muddy shoreline at equilibrium. If the profile of a tidal mud flat can be changed from a low, concave, degraded shape to a high, convex, accretionary shape, the stability of the shoreline itself and of any artificial coast defences behind the mud flat will be increased.

Accordingly, the present invention provides a method of regeneration, by addition of replenishment material thereto, of a shoreline comprising tidal mud flats which are degrades or are being eroded, characterised in that the method comprises the steps of ascertaining the ambient tidal range and wave climate of a mud flat to be regenerated, deriving from these data a regenerated convex profile for the mud flat and a modified wave climate under which said regenerated profile would be stable, and depositing replenishment material comprising densified or dewatered mud or clay on the mud flat to build the convex profile; further characterised in that breakwater or barrier means are placed to modify the wave climate and sedimentary regime of the mud flat so as to render the mud flat receptive to deposition and retentive of the deposited mud or clay, whereby a new shoreline profile is established which is in equilibrium with the modified wave climate.

The regeneration of the entire profile of the shoreline and the establishment of a new profile which is in equilibrium with the modified wave climate according to the invention is preferable to attempting to regenerate only that part of the profile of a shoreline between the mean tidal level and the mean high tide level, which would result in an unstable profile out of equilibrium with the ambient wave climate and would leave the shoreline vulnerable to erosion at lower tidal levels.

Typically, the modification of the wave climate, and hence of the sedimentary regime, involves the suppression of high and short-period waves which would otherwise cause erosion of the mud flat and its reversion to the pre-regeneration profile which, in the absence of any modification, would be the profile closest to equilibrium with the ambient wave climate.

The new profile for the mud flat to be regenerated may be derived empirically by the identification and copying of a natural analogue, but the regenerated profile to be built is preferably calculated from hydrodynamic data relating to the mud flat, such as tidal range, wave climate, wave or wind fetch, wave attenuation, and shear stress variation across the tidal flat.

The amount of mud or clay required to build the regenerated profile may also be derived empirically by carrying out a bathymetric and topographic survey to determine the existing profile of the mud flat and then by comparing the existing profile with the regenerated profile to be achieved.

The regenerated profile may be calculated from the hydrodynamic data by means of a mathematical model which may also be used to determine the extent to which the wave climate has to be modified by the breakwater or barrier means.

The method of the invention may employ a mathematical model which calculates the regenerated profile by manipulating two equations for determining equilibrium profiles for a current-dominated tidal flat and a wave-dominated tidal flat, respectively, on the basis of the two components of the shear stress across a tidal flat.

The first of these components are the currents generated along the shore and perpendicular to the slope of the mud flat by the tides. At equilibrium, the constant critical value of maximum shear stress over a mud flat in the absence of waves determines the profile of the flat and is a function of tidal range, the width of the flat, and the distance from the high-water mark. The mathematical model generates mud flat profiles as functions of these variables and determines flat widths as functions of assumed critical shear stresses. For an equilibrium flat along a straight shoreline:

$$L^*/L=(\pi/2-1)^{-1} \quad (1)$$

where $L^*$=the length of the lower part of the profile,

L=the distance from the low-water mark to the high-water mark, and $\pi$=3.142

Equation 1 results in a convex equilibrium profile for a current-dominated store, a result which is in accordance with the observation that mud flats built largely or entirely by currents tend to be accretionary and convex in shape. If the mud flat abuts a salt marsh, its equilibrium profile will be altered in that the overall convexity will be modified.

The second component of the shear stress is contributed by wind waves and the stress due to such waves is determined by variations in the height and period of the waves. Where a tidal mud flat is exposed to storm waves and tidal current components are weak, the equilibrium profile of the mud flat will be controlled by the wave climate. In a hypothetical situation where tidal currents are negligible and shear stresses are due entirely to waves, it being assumed that the wind waves propagate perpendicularly to the shore without breaking and that there is no component of wave reflection at the shore (a situation to some degree applicable to gently sloping, highly dissipative tidal mud flats), then for an equilibrium flat on a straight shoreline, that is, a shoreline having a uniform distribution of wave orbital velocity across the entire flat:

$$h(x)/ho=(1-x/L)^{2/3} \quad (2)$$

where h=h(x)=the depth of the tidal flat profile, ho=the high water depth at x=o and is equal to the tidal range, L=the distance from the low water mark to the high water mark, and x=the horizontal distance in a direction normal to the shore.

Along a straight shoreline, the equilibrium profile for a wave-dominated tidal mud flat under the conditions specified above is concave.

The mathematical model mentioned above manipulates equations (1) and (2), using local and real input data on tidal range, calculated longitudinal and perpendicular shear stresses on spring flood and spring ebb tides, and wave-height and wave-period data derived from measurements of the wind fetch and aspect of the tidal mud flat to be regenerated. The model may be refined to accommodate breaking waves and wave refraction across a mud flat and also to accommodate variations in tidal shear stresses for curved shorelines.

In a preferred embodiment, however, the method uses a mathematical model which employs the concept of a spatially uniform, wave-mean rate of energy dissipation per unit area of a mud flat to develop a cross-shore mud profile geometry for nearshore waters and which can predict convex accretionary nearshore profiles. The model is based on the recognition that, in contrast to a sandy or gravelly shorelines where wave energy is dissipated primarily through friction with the bottom and water-column turbulence due to the breaking of the waves, waves traversing a muddy shoreline lose their energy primarily through viscous dissipation within the soft, muddy bottom due to wave-induced motion or fluidisation of the mud and that allowance must be made for this process.

The modality of profile change on a muddy shoreline is dependent on a profile-averaged wave attenuation coefficient $\bar{k}_i$, which characterises the fluidisation potential of mud. The value $\bar{k}_i$, as calculated from the solution of a two-layer linear wave—soft bottom interaction problem, is a function of mud rheology and this, in turn, is dependent on incident wave height. Hence, a high value of $\bar{k}_i$ indicates the presence of a correspondingly-thick fluid mud layer which has been shown to increase with increasing mean rate of energy dissipation, and hence with increasing wave height, in laboratory experiments. A high $\bar{k}_i$ value is indicative of an erosional, concave profile, whereas a lower $\bar{k}_i$ value implies low wave height and an accretionary, convex profile. This trend does not extend, however, to the inner surf zone, where wave breaking is a more significant cause of energy dissipation than the absorption of wave energy by the muddy bottom. Preferably, therefore, an empirical nearshore depth correction term is included in the model to improve the accuracy of prediction for the inshore portion of the profile.

In the preferred model, the geometry of the profile to be regenerated is defined as follows:

$$h = h_o \exp^{4\bar{k}_i(y_o-y)}\left(\frac{y}{y_o}\right)^2 \quad (4)$$

and this can conveniently be non-dimensionalised as:

$$\hat{h}=\exp^{4K(1-\hat{y})}\hat{y}^2 \quad (5)$$

where $\hat{y}=y/y_o$, $\hat{h}=h/h_o$, and $K=\bar{k}_i\, y_o$ and is a non-dimensional wave parameter which scales $\bar{k}_i$ by the width of the profile, $y_o$.

In equations (4) and (5):

h=the water depth, $h_o$=the water depth at an offshore limit of the profile beyond the low-water mark, $\hat{h}$=the non-dimensional water depth, expressed as a ratio or percentage, $\bar{k}_i$=the profile-averaged wave attenuation coefficient, K=the non-dimensional wave attenuation parameter, expressed as a percentage, y=the length of the profile along a horizontal axis normal to the shoreline at the mean water level, $y_o$=the width of the profile from the high-water mark to the offshore limit, and $\hat{y}$=the non-dimensional value of the y coordinate.

In, practice, as mentioned above, data on local tidal range and wave fetch will be used to estimate the tidal stream and wave climate at the mud flat to be regenerated and the results of rheological measurements will indicate the condition of the surface of the mud flat. The model will thus calculate a new, convex shape for the degraded, concave mud flat to be regenerated, taking account of the modified wave climate brought about by the breakwater or barrier means.

The mud or clay used to build the regenerated profile may be drawn from any source but, since eroding muddy shorelines often create the need to dredge adjacent navigational channels, the mud or clay used may conveniently comprise muddy dredge spoil. The dredge spoil may be processed both to remove coarse debris and contaminants, such as heavy metals, and to achieve a level of densification or dewatering such that it has a consistency capable of forming and maintaining the desired profile, for example, a consistency such that the mud or clay can retain its position on sloping ground and adopt a stable inclined surface.

Preferably, dewatering is effected by a chemical additive, such as quicklime (CaO), which reacts with the water in the spoil to generate heat and hence to bring about water loss and densification. The final consistency of the processed mud or clay is determined by the amount of additive used and may range from malleable to solid-setting, depending upon the particular requirements of use. The additive may also bind chemical contaminants or pollutants in the spoil.

Alternatively, the dredge spoil may be processed mechanically in accordance with the technology employed at the METHA Plant in Hamburg, as described in Detzner H-D, "Mechanical Treatment of the Dredged Material from the Hamburg Harbour", CAT II Congress, Session 3: Treatment; pages 3.25–3.28, Antwerp, 15 to Nov. 17, 1993.

The processed dredge spoil or other mud or clay may be brought to the site of deposition on the mud flat, for example, by open conveyors for laying by gravity in air or through shallow water or by being pumped in a plastic state along pipelines for laying underwater. In some cases, it is preferable for the mud or clay to be deposited from shore-based plant because the upper levels of a mud flat are exposed for longer periods than the lower levels and require a greater covering of deposited mud to build the desired profile.

In other cases, however, it is preferable to deposit the mud or clay from offshore plant, for example, a stock barge, because the exposed surface of the mud flat will not support the traffic of shore-based plant and will be further degraded by shore-based operations. In preferred embodiments, the mud or clay is conveyed from the stock barge to the site of deposition by a train of floating conveyors which can be extended inshore and retracted offshore as the tide flows and ebbs across the mud flat, the output end of the conveyor train being connected to the barge or the shore by stays which hold the conveyor steady against any currents and allow the output end to be moved across the mud flat to change the site of deposition, or by a pipeline with, for example, a spreader head at its outlet end for laying the mud or clay underwater. The spreader head is preferably flared in shape. In the preferred embodiments, the conveyor train or spreader head is supported by shallow-draft flotation devices for shallow water operation.

The breakwater or barrier means which are used to modify the wave climate and sedimentary regime of the mud flat to maintain its accretionary condition, and hence to preserve the regenerated profile, may be onshore, that is, in the intertidal zone, or offshore. The breakwater or barrier means do not have to be continuous and, in the case of an offshore breakwater or barrier, need not be a full-water-depth structure. An offshore breakwater or barrier may be submerged and may have its top at about mid-tide level so as to protect the mud flat from wave action between low-tide and mid-tide, while permitting the passage of small waves between mid-tide and high-tide.

The breakwater or barrier means may comprise groynes of rubble, wood or other suitable materials running out from the shore, substantially perpendicular thereto, to act as breakwaters and to resist longshore movement of the deposited mud, a series of bunds parallel to the shore in the intertidal zone to retain the deposited mud and act as breakwaters, or a low-water or offshore berm or breakwater. The groynes or bunds may be arranged to act as a former to control the new shore profile and to ensure that the desired profile is met by the deposition of the mud. Such formers may also limit failure or slumping at the edges of the new profile. In sheltered localities, low mud walls, palisades or brushwood fencing may be employed. In other cases, grounded barges filled with waste rock or even banks of quarried stone, rubble, old tires, pre-cast concrete blocks or the like may be used to form barriers or breakwaters.

In a preferred embodiment, however, the breakwater or barrier means are offshore and comprise a floating breakwater adapted to suppress high and short-period waves but to permit the passage of low and long-period waves.

In an estuarine locality, the breakwater or barrier means may be located on the crest of a mud flat between two creeks, rather than below the low-water mark. In such a location, the regeneration of the mud flat may reduce the wave fetch by an extent such that the breakwater or barrier means may eventually be removed.

The use of muddy dredge spoil as the mud for building the regenerated profile of the mud flat has the advantage that a useless waste from dredging operations is converted into a useful resource.

The method of the present invention achieves a self-preserving, regenerated profile which requires no subsequent intervention to recharge the profile, other than in exceptional circumstances due to storm damage.

I claim:

1. A method of regeneration of a shoreline comprising tidal mud flats which are degraded or are being eroded by adding or replenishing material thereto comprising the following steps ascertaining the ambient tidal range and wave climate data of a mud flat to be regenerated, deriving from these data a modified wave climate under which a regenerated shoreline profile would be stable, and depositing replenishment material comprised of densified or dewatered mud or clay on the mud flat to build a convex profile including the step of placing breakwater or barrier means to modify the wave climate and sedimentary regime of the mud flat so as to render the mud flat receptive to deposition and retentive of the deposited mud or clay, whereby a new shoreline profile is established which is in equilibrium with the modified wave climate.

2. A method according to claim 1, further comprising calculating the regenerated convex profile to be built from hydrodynamic data relating to the mud flat.

3. A method according to claim 2, further comprising calculating the regenerated profile in accordance with the equation:

$$\hat{h}=\exp^{4K(1-\hat{y})}\hat{y}^2$$

where $\hat{y}=y/y_o$, $\hat{h}=h/h_o$, and $K=\overline{k}_i\, y_o$, and where h is the water depth, $h_o$ is the water depth at an offshore limit of the profile beyond the low-water mark, $\hat{h}$ is the non-dimensional water depth, $\overline{k}_i$ is the profile-averaged wave attenuation coefficient, K is the non-dimensional wave attenuation parameter, y is the length of the profile along a horizontal axis normal to the shoreline at mean water level, $y_o$ is the width of the profile from the high-water mark to the offshore limit, and $\hat{y}$ is the non-dimensional value of y co-ordinate.

4. A method according to claim 2, characterised in that it further comprises the steps of carrying out a bathymetric and topographic survey of the mud flat to be regenerated in order to determine the existing profile and comparing the existing profile with the regenerated profile to determine the amount of mud or clay required to build the regenerated profile.

5. A method according to claim 1, depositing the mud or clay on the mud flat from shore based plant.

6. A method according to claim 1, depositing the mud or clay on the mud flat from an offshore barge, and pumping the mud or clay in a plastic state along a pipeline from the barge to the site of deposition.

7. A method according to claim 6, depositing the mud or clay underwater through a spreader head at the outlet end of the pipeline.

8. A method according to claim 1, characterized in that the breakwater or barrier means are offshore.

9. A method according to claim 8, characterised in that the offshore breakwater or barrier means comprise a floating breakwater adapted to suppress high and short-period waves and to permit the passage of low and long-period waves.

10. A method according to claim 1, characterised in that the mud or clay is muddy dredge spoil.

11. A method according to claim 10, processing the muddy dredge spoil prior to deposition to achieve a consistency capable of forming and maintaining the regenerated profile.

* * * * *